US011283193B2

(12) United States Patent
Ying et al.

(10) Patent No.: US 11,283,193 B2
(45) Date of Patent: Mar. 22, 2022

(54) SUBSTRATE INTEGRATED WAVEGUIDE ANTENNA

(71) Applicant: SONY MOBILE COMMUNICATIONS INC., Tokyo (JP)

(72) Inventors: Zhinong Ying, Lund (SE); Kun Zhao, Stockholm (SE)

(73) Assignee: Sony Group Corporation, Tokyo (JP)

( * ) Notice: Subject to any disclaimer, the term of this patent is extended or adjusted under 35 U.S.C. 154(b) by 0 days.

(21) Appl. No.: 16/960,806

(22) PCT Filed: Mar. 8, 2018

(86) PCT No.: PCT/IB2018/051518
§ 371 (c)(1),
(2) Date: Jul. 8, 2020

(87) PCT Pub. No.: WO2019/171148
PCT Pub. Date: Sep. 12, 2019

(65) Prior Publication Data

US 2020/0403324 A1 Dec. 24, 2020

(51) Int. Cl.
*H01Q 1/38* (2006.01)
*H01Q 21/24* (2006.01)
(Continued)

(52) U.S. Cl.
CPC ..... *H01Q 21/24* (2013.01); *H01Q 1/2283* (2013.01); *H01Q 9/0407* (2013.01)

(58) Field of Classification Search
CPC ..... H01Q 21/24; H01Q 1/2283; H01Q 9/0407
See application file for complete search history.

(56) References Cited

U.S. PATENT DOCUMENTS 3,623,112 A 11/1971 Rupp
2016/0380359 A1 12/2016 Cooper et al.
(Continued)

FOREIGN PATENT DOCUMENTS

CN 107 689 490 A 2/2018
JP 2021503227 A 2/2021
KR 2007 0116558 A 10/2017

OTHER PUBLICATIONS

International Search Report and Written Opinion from corresponding International Application No. PCT/IB2018/051518, dated Oct. 23, 2018, 14 pages.
(Continued)

*Primary Examiner* — Peguy Jean Pierre
(74) *Attorney, Agent, or Firm* — Tucker Ellis LLP

(57) ABSTRACT

A SIW-antenna includes a SIW-structure extending along a horizontal plane for guiding electromagnetic waves along a longitudinal direction from a first feed to a radiation aperture, and a parallel plate resonator arranged at the radiation aperture and having a first flat portion extending in a first plane parallel with the horizontal plane and a second flat portion extending in a second plane parallel with the horizontal plane. The first and second planes are separate from each other. The first flat portion has an additional antenna structure connected to a second feed. The second flat portion has a plurality of flat tabs extending in the longitudinal direction. The SIW-structure is configured to radiate electromagnetic waves polarized in a first direction. The additional antenna structure is configured to radiate electromagnetic waves polarized in a second direction orthogonal to the first direction.

19 Claims, 3 Drawing Sheets

(51) Int. Cl.
*H01Q 1/22* (2006.01)
*H01Q 9/04* (2006.01)

(56) References Cited

U.S. PATENT DOCUMENTS

2019/0305396 A1* 10/2019 Dogiamis ..... H01P 5/12
2020/0358161 A1* 11/2020 Shin ..... H01P 11/002

OTHER PUBLICATIONS

Luo, Yu et al., "Substrate integrated waveguide circularly polarized horn-dipole antenna with improved gain," Microwave and Optical Technology Letters, vol. 58, No. 12, Sep. 22, 2016, pp. 2973-2977.
M. Esquius-Morote et al.: "Novel Thin and Compact H-Plane SIW Hom Ante nna", IEEE Transactions on Antennas and Propagation, vol. 61, No. 6,; dated 2013; pp. 2911-2920.

* cited by examiner

SUBSTRATE INTEGRATED WAVEGUIDE ANTENNA

TECHNICAL FIELD

The present invention relates to a substrate integrated waveguide antenna. The present invention further relates to an array antenna comprising a plurality of substrate integrated waveguide antennas.

BACKGROUND

In mobile industry today higher frequency bands such as the mm wave band, 10 GHz up to about 100 GHz, is heavily investigated due to the potential bandwidth available. In order to achieve good performance in the mm wave band an array antenna comprising multiple antennas arranged in an array antenna will most probably be needed. This both in order to achieve antenna diversity and in order to get an antenna that may emit electromagnetic waves having dual polarization. Antenna diversity may be achieved because multiple antennas offer a receiver several observations of the same signal. Further, dual polarization antennas may be used for multiplexing wherein two channels of information may be transmitted on the same carrier frequency by using waves of two orthogonal polarization states.

Today dual polarization in an array antenna is achieved by arranging a first sub-group of antennas of the array antenna to emit waves with a first polarization direction and a second sub-group of antennas of the array antenna to emit waves having a polarization direction being orthogonal to the first polarization direction. This is illustrated in FIG. 1. The prior art antenna array 1 of FIG. 1 comprises two types of antennas 2*a*, 2*b*. The first type of antennas 2*a* (belonging to the first sub-group of antennas) is configured to emit waves having a first polarization direction and the second type of antennas 2*b* (belonging to the second sub-group of antennas) is configured to emit waves having a polarization direction being orthogonal to the first polarization direction. This prior art array antenna allows for both antenna diversity and multiplexing. However, such an array antenna leaves a relatively large footprint in the electronic device wherein it is used.

Hence, there is a need for an alternative antenna having dual polarization capabilities that may be used in an array antenna. Preferably, such an antenna is to be designed such that the footprint of the antenna is reduced compared with the prior art array antenna of FIG. 1.

Further design considerations when developing a new antenna may be distinctiveness of polarization direction, low coupling between different antennas in an array antenna and limitation of ground currents from the antennas.

SUMMARY OF THE INVENTION

In view of the above, it is an object of the present invention to provide an antenna that may be used in an array antenna. The provided antenna may also be configured to have dual polarization.

According to a first aspect a Substrate Integrated Waveguide, SIW, antenna, is provided. The SIW-antenna comprises:

a SIW-structure extending along a horizontal plane for guiding electromagnetic waves along a longitudinal direction from a first feed to a radiation aperture, and a parallel plate resonator arranged at the radiation aperture, the parallel plate resonator comprising a first flat portion extending in a first plane parallel with the horizontal plane and a second flat portion extending in a second plane parallel with the horizontal plane, wherein the first and second planes are separate from each other;

wherein the first flat portion comprises an additional antenna structure being connected to a second feed, wherein the second flat portion comprises a plurality of flat tabs extending in the longitudinal direction, wherein the SIW-structure is configured to radiate electromagnetic waves polarized in a first direction and wherein the additional antenna structure is configured to radiate electromagnetic waves polarized in a second direction, wherein the second direction is orthogonal to the first direction.

A SIW-antenna is a good type of antenna for electronic devices due to its compact structure. The SIW-antenna may form part of a printed circuit board and is hence easy to manufacture. A typical SIW-antenna is configured to radiate electromagnetic waves polarized in a first direction. The present SIW-antenna is in addition configured to radiate electromagnetic waves polarized in a second direction orthogonal to the first direction. The latter due to the specific design of the parallel plate resonator. The first direction is vertical with respect to the horizontal plane of the SIW-structure, the SIW-structure being a parallel plate resonator. In the below description the first direction will be referred to a vertical direction. Hence, the SIW-structure is said to radiate vertically polarized electromagnetic waves. In the below description the second direction will be referred to a horizontal direction. Hence, the additional antenna structure is said to radiate horizontally polarized electromagnetic waves. Accordingly, the SIW-structure and the additional antenna structure may radiate vertically polarized electromagnetic waves and horizontally polarized electromagnetic waves, respectively. The present SIW-antenna presents a design allowing both vertically polarized electromagnetic waves and horizontally polarized electromagnetic waves to be emitted by the same antenna. This allows for a smaller antenna wherein the footprint of the antenna in a device wherein the antenna is used is reduced. Hence, a compact dual polarization antenna may be provided. The SIW-antenna may further be designed such that the frequency of the radiated electromagnetic waves is in the range of 10 GHz 100 GHz. Hence, a dual polarization antenna configured for radiating electromagnetic waves having wavelength in the range of millimeters may be provided. Such an antenna may be useful for mm wave communication systems. The mm wave communication system may e.g. be a 5G wireless communication system. The present design may further allow for a very pure polarization, with low cross polarization level. According to simulations, at least 20 dB lower than the co-polarization.

The first and second flat portions may be asymmetric with respect to each other. The asymmetric first and second flat portions allow for designing the SIW-antenna such that both the SIW-structure and the additional antenna structure radiates towards the same direction.

The first feed may be separate from the second feed. This may allow for individually controllable antenna structures within the SIW-antenna. Hence, the amount of vertically vs horizontally polarized electromagnetic radiation may be controlled.

The plurality of flat tabs may be curved.

The plurality of flat tabs may be triangle shaped.

The plurality of flat tabs may be rectangular shaped.

The plurality of flat tabs may be frusto-triangular shaped.

One of more of the plurality of flat tabs may have one of the above mentioned shapes and other one or more of the plurality of flat tabs may have another one of the above mentioned shapes. Hence, not all of the plurality of tabs may need to have the same shape.

The plurality of flat tabs may be electrically separated from each other. Alternatively, the plurality of flat tabs may be electrically connected to each other. Further alternatively, one or more of the plurality of flat tabs may be electrically separated from the other ones of the plurality of flat tabs and at the same time a sub-group of the plurality of flat tabs may be electrically connected to each other. By electrically separating the flat tabs from each other, their impact on the radiation pattern of the additional antenna structure will be less. By electrically connecting the plurality of flat tabs, their effect as matching structure to increase the bandwidth of the vertical polarized SIW-structure may be enhanced.

As mentioned above, the SIW structure and the additional antenna structure may be configured to radiate electromagnetic waves towards a common direction. The common direction may be out from the radiation aperture along the longitudinal direction.

The additional antenna structure may comprise a flat patch for a flat monopole antenna.

The additional antenna structure may comprise at least two flat patches electrically insulated from each other. The at least two flat patches may form a flat diploe antenna.

A first one of the at least two flat patches may be connected to ground.

A second one of the at least two flat patches may be connected to the second feed.

As mentioned above, the SIW-structure may be configured to radiate vertically polarized electromagnetic waves. The additional antenna structure may be configured to radiate horizontally polarized electromagnetic waves.

The additional antenna structure may be oriented transversely to the longitudinal direction of the SIW-structure.

The SIW-structure may comprise an upper layer and a lower layer, wherein a distance between the upper and lower layers is in the range of 1.0-3.0 mm. Having this distance in this range is preferred since then the SIW-structure may produce electromagnetic radiation in the mm wave band suitable for mm wave communication systems such as e.g. a 5G wireless communication system. Further, this range of distance is preferred since it corresponds to a thickness of circuit boards in which the SIW-antenna may be integrated.

The number of the plurality of flat tabs may be in the range of 3-10.

According to a second aspect an antenna array is provided. The antenna array comprises a plurality of SIW-antennas according to the first aspect.

The present design may provide a compact structure since every SIW-antenna is configured to radiate both vertically and horizontally polarized electromagnetic radiation. Hence, the present design may allow for reducing the footprint of the antenna array as compared for example with an array antenna as illustrated in FIG. 1.

The preset design may further give freedom to where to place the antenna array. The antenna array may form part of a circuit board. The antenna array may be placed at an edge of a circuit board. Hence, the present antenna may be easily integrated in for example a mobile device. The present antenna may, e.g., form part of a circuit design of the mobile device.

The above mentioned features of the SIW-antenna, when applicable, apply to this second aspect as well. In order to avoid undue repetition, reference is made to the above.

According to a third aspect an electronic device is provided. The electronic device is configured to communicate within a millimeter wave communication system. The mm wave communication system may e.g. be a 5G wireless communication system. The electronic device comprises an antenna array according to the second aspect.

The above mentioned features of the SIW-antenna, when applicable, apply to this third aspect as well. In order to avoid undue repetition, reference is made to the above.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described or steps of the methods described as such device and method may vary. It is also to be understood that the terminology used herein is for purpose of describing particular embodiments only, and is not intended to be limiting. It must be noted that, as used in the specification and the appended claims, the articles "a," "an," "the," and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTION OF THE DRAWINGS

The above and other aspects of the present invention will now be described in more detail, with reference to appended drawings showing embodiments of the invention. The figures should not be considered limiting the invention to the specific embodiment; instead they are used for explaining and understanding the invention.

As illustrated in the figures, the sizes of layers and regions may be exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and to fully convey the scope of the invention to the skilled person.

Figure 2:
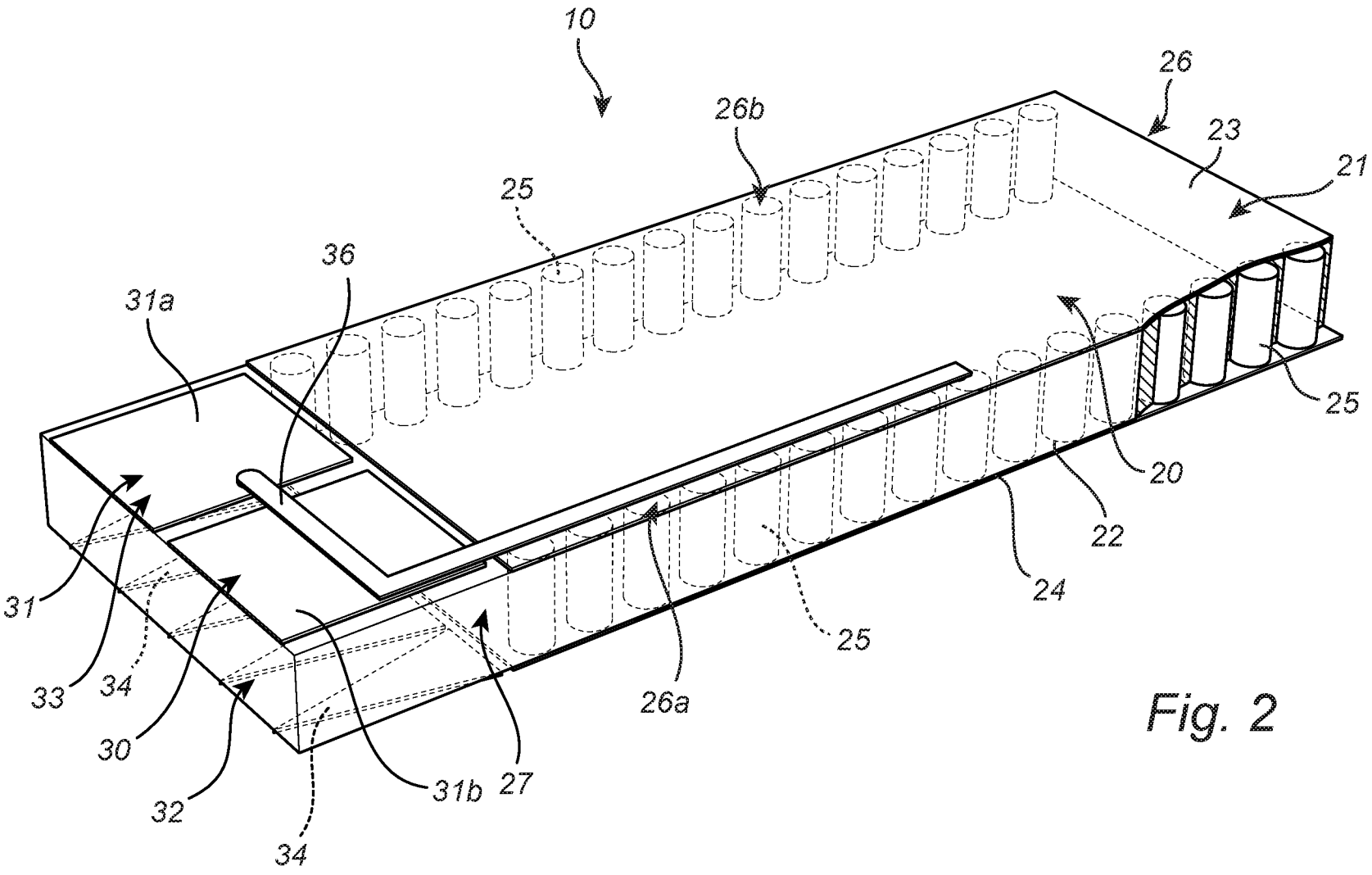
FIG. 2 illustrate a substrate integrated waveguide antenna.

FIG. 2 illustrates a Substrate Integrated Waveguide, SIW, antenna 10 according to the present invention. In the literature the SIW antenna may also be referred to as a post-wall waveguide or a laminated waveguide. The SIW antenna 10 according to the present invention comprises a SIW structure 20 and a parallel plate resonator 30.

The SIW structure 20 is a rectangular guide 21 for electromagnetic waves. The guide 21 is formed within a substrate 22. The substrate 22 is made of a dielectric material. The substrate 22 may form part of a circuit board. The thickness of the substrate 22 may be a fraction of the wavelength of the electromagnetic waves being guided through the SIW-structure 20. According to a non-limiting example, the thickness of the substrate 22 may be ⅛ of the wavelength of the electromagnetic waves being guided through the SIW-structure 20. For implementations within a system using a millimeter wave communication system, i.e. 10 GHz-100 GHz, substrate thicknesses of 1.0-3.0 mm may be used.

The guide 21 is defined by an upper layer 23, a lower layer 24 and two rows of posts 25. The upper and lower layers 23, 24 are supported by the substrate 22. The upper and lower layers 23, 24 is made of electrically conducting material. The electrically conducting material is typically a metal. The upper and lower layers 23, 24 constitute opposing major surfaces of the SIW structure 20. The upper and lower layers 23, 24 may be parallel to each other. The posts 25 may be formed as via holes through the substrate 22. A respective one of the two rows of posts 25 form a via fence 26*a*, 26*b*. The two via fences 26*a*, 26*b* constitutes side walls of the SIW-structure 20. The posts 25 comprise electrically conductive material and connects the upper and lower layers 23, 24. Hence, the upper and lower layers 23, 24 together with the two rows of posts 25 forms the guide 21 for electromagnetic waves. The guide 21 extends along a horizontal plane of the SIW-structure 20. The guide 21 is configured to guide electromagnetic waves along a longitudinal direction of the SIW-structure 20, from a first feed 26 to a radiation aperture 27. To an electromagnetic wave the guide 21 looks like a dielectrically-filled rectangular waveguide starting at the first feed 26 and ending at the radiation aperture 27. The SIW-structure 20 is configured to radiate vertically polarized electromagnetic waves upon being feed at the first feed 26.

The parallel plate resonator 30 is arranged at the radiation aperture 27 of the SIW-structure 20. The parallel plate resonator 30 is configured to work as a transition region for the SIW-structure 20 in order to reduce reflections at the radiation aperture 27. By this an improved matching of the SIW-structure 20 is achieved. The parallel plate resonator 30 comprises two parallel plates. A first of the parallel plates comprises a first flat portion 31. A second of the parallel plates comprises a second flat portion 32. The first and second flat portions 31, 32 comprises electrically conducting material. The electrically conducting material is typically a metal. The parallel plates have a main extension oriented transversely to the longitudinal direction or the SIW-structure 20. According to a none limiting example, each of the parallel plates may have an extension in the direction transversal to the longitudinal direction of the SIW-structure 20 being approximately half of the wavelength the SIW-structure 20 is dimensioned to emit. Further, according to a none limiting example, each of the parallel plates may have an extension in the longitudinal direction of the SIW-structure 20 being approximately a quarter of the wavelength the SIW-structure 20 is dimensioned to emit. However, the dimensions may vary depending on the implementation of the SIW, antenna 10. The parallel plate resonator 30 may reduce reflections at the radiation aperture 27. Further, the parallel plate resonator 30 may increase the bandwidth of the SIW-structure 20.

The first flat portion 31 is extending in a first plane parallel with the horizontal plane of the SIW-structure 20. The second flat portion 32 is extending in a second plane parallel with the horizontal plane of the SIW-structure 20. The first and second planes are separate from each other. The first and second flat portions 31, 32 may be separated by a substrate 35. The substrate 35 is made of a dielectric material. The substrate 35 of the parallel plate resonator 30 may be made of the same material as the substrate 22 of the SIW-structure 20. The substrate 35 of the parallel plate resonator 30 may form part of a circuit board. The substrate 35 of the parallel plate resonator 30 and the substrate 22 of the SIW-structure 20 may form part of the same circuit board. The substrate 35 of the parallel plate resonator 30 may be forming an extension of the substrate 22 of the SIW-structure 20. The substrate 35 of the parallel plate resonator 30 may have the same thickness as the substrate of the SIW-structure.

The parallel plate resonator 30 as proposed herein is in addition configured to operate as a separate additional antenna. This additional antenna is configured to radiate horizontally polarized electromagnetic waves. The additional antenna is formed by integrating an additional antenna structure 33 in the first flat portion 31. The additional antenna structure 33 is formed by one or more flat patches 31*a*, 31*b* of the first flat portion 31. The additional antenna structure 33 has its main extension in a direction transversely to the longitudinal direction of the SIW-structure 20. Hence, the additional antenna structure 33 is oriented transversely to the longitudinal direction of the SIW-structure 20. This allow the additional antenna structure 33 to acts as a "plate" in the parallel plate resonator 30. According to a none limiting example, the additional antenna structure 33 may have an extension in the direction transversal to the longitudinal direction of the SIW-structure 20 being approximately half of the wavelength the SIW-structure 20 is dimensioned to emit. Further, according to a none limiting example, the additional antenna structure 33 may have an extension in the longitudinal direction of the SIW-structure 20 being approximately a quarter of the wavelength the SIW-structure 20 is dimensioned to emit. However, the dimensions may vary depending on the implementation of the SIW, antenna 10. Further, the additional antenna structure 33 is connected to a second feed 36. The additional antenna structure 33 may comprise a flat patch forming a flat monopole antenna. The additional antenna structure 33 may comprise two flat patches forming a flat dipole antenna. Hence, the first flat portion 31 may comprises one or more flat patches 31*a*, 31*b*. The one or more flat patches 31*a*, 31*b* is made of electrically conducting material. The electrically conducting material is typically a metal. The one or more flat patches 31*a*, 31*b* may be supported by the substrate 32 of the parallel plate resonator 30. The additional antenna structure 33 comprises the one or more flat patches 31*a*, 31*b*.

The example with the flat dipole antenna is illustrated in FIG. 2. According to this embodiment the additional antenna structure 33 comprises two flat patches 31*a*, 31*b*. A first one 31*b* of the flat patches may be connected to ground. According to the in FIG. 2 illustrated example, this is achieved by connecting the first one 31*b* of the flat patches to the upper layer 23 of the SIW-structure 20 via ground connection 39. According to this example, the upper layer 23 of the SIW-structure 20 constitutes a ground layer of the SIW-structure 20. A second one 31*a* of the flat patches is connected to the second feed 36. The second feed 36 may be a strip line feed.

Hence, the SIW-antenna 10 may be looked upon as a dual antenna, wherein the SIW-structure 20 constitutes a first antenna structure and the additional antenna structure 33 constitutes a second antenna structure. Both the first and second antenna structures are configured to radiate electromagnetic waves towards a common direction. The first antenna structure is configured to radiate vertically polarized electromagnetic waves. The second antenna structure is configured to radiate horizontally polarized electromagnetic waves.

The second flat portion 32 comprises a plurality of flat tabs 34. The plurality of flat tabs 34 are extending in the longitudinal direction of the SIW-structure 20. The plurality of flat tabs 34 may have their main extension in the longitudinal direction of the SIW-structure 20. The plurality of flat tabs 34 may be electrically insulated from the electrically conducting portions of the SIW-structure 20.

The one or more flat patches 31*a*, 31*b* of the first flat portion 31 is forming a first one of the "plates" in the parallel plate resonator 30. The plurality of flat tabs 34 is forming a second one of the "plates" in the parallel plate resonator 30.

The one or more flat patches 31*a*, 31*b* of the first flat portion 31 may be asymmetric with respect to the flat tabs 34 of the second flat portion 32. Hence, the flat tabs 34 of the second flat portion 32 may be differently shaped, or have a different periodicity, as compared with the one or more flat patches 31*a*, 31*b* of the first flat portion 31. Further, the second flat portion 32 may be a corrugated structure, wherein the flat tabs 34 may be seen as the tops, and the space between them may be seen as the valleys in the corrugated structure.

Since the flat tabs 34 of the second flat portion 32 are asymmetric with respect to the one or more flat patches 31*a*, 31*b* of the first flat portion 31, the second flat portion 32 in the parallel plate resonator 30 will be transparent to the electromagnetic waves emitted by the additional antenna structure 33. On the contrary, if the flat tabs 34 of the second flat portion 32 would be symmetric with respect to the one or more flat patches 31*a*, 31*b* of the first flat portion 31 the second flat portion 32 would act as a reflector for the electromagnetic waves emitted by the additional antenna structure 33. Accordingly, since the flat tabs 34 of the second flat portion 32 are asymmetric with respect to the one or more flat patches 31*a*, 31*b* of the first flat portion 31 the radiation pattern of the additional antenna structure 33 will have the same direction as the radiation pattern from the SIW-structure 20.

The plurality of flat tabs 34 may have a periodic structure. Hence, the plurality of flat tabs 34 may form a patch having a periodically repeating pattern. The periodically repeating pattern of the plurality of flat tabs 34 may be different from a periodicity of the one or more flat patches 31*a*, 31*b* of the first flat portion 31. According to non-limiting examples, the plurality of flat tabs 34 may be curved, triangle shaped, rectangular shaped, or frusto-triangular shaped. The periodic structure of the plurality of flat tabs make less currents in parallel with the direction of the additional antenna structure. The triangular shape may be the preferred structure. This since it has a minimum total area, which effects the radiation pattern of the additional antenna structure the least. The triangular shape presents a parasitic element function for SIW-structure to enhance the bandwidth. Further, the triangular shape presents a low amount of scattering for the additional antenna structure.

The number of the plurality of flat tabs 34 may be in the range of 3-10.

The plurality of flat tabs 34 may be electrically separated from each other. By separating the plurality of flat tabs 34 from each other, their impact on the radiation pattern of the additional antenna structure 33 will be reduced. The plurality of flat tabs 34 may be electrically connected to each other. By connect the plurality of flat tabs 34 together, their effect as matching structure to increase the bandwidth of the SIW antenna may be enhanced. Hence, the connecting or not connecting of the plurality of flat tabs 34 to each other depend on which specific properties the SIW-antenna 10 is designed for.

The first flat portion 31 may extend in a same plane as either the upper and lower layer 23, 24 of the SIW-structure. The second flat portion 32 may extend in a same plane as the other of the upper and lower layer 23, 24 of the SIW-structure.

As mentioned above, the asymmetry between the one or more flat patches 31*a*, 31*b* of the first flat portion 31 and the flat tabs 34 of the second flat portion 32 allow both the SIW-structure 20 and the additional antenna structure 33 radiate toward a same direction. Hence, the SIW-structure and the additional antenna may be configured to radiate electromagnetic waves towards a common direction.

The SIW-structure 20 is an aperture antenna which has an end-fire pattern meaning that the SIW-structure 20 radiate along the longitudinal direction of the SIW-structure 20. As discussed above, the parallel plate resonator 30 may be designed such that the additional antenna structure 33 has similar emission pattern. However, the additional antenna structure 33 is configured to radiate electromagnetic radiation having a polarization being orthogonal to the polarization of the electromagnetic radiation emitted from the SIW-structure 20.

Figure 1:
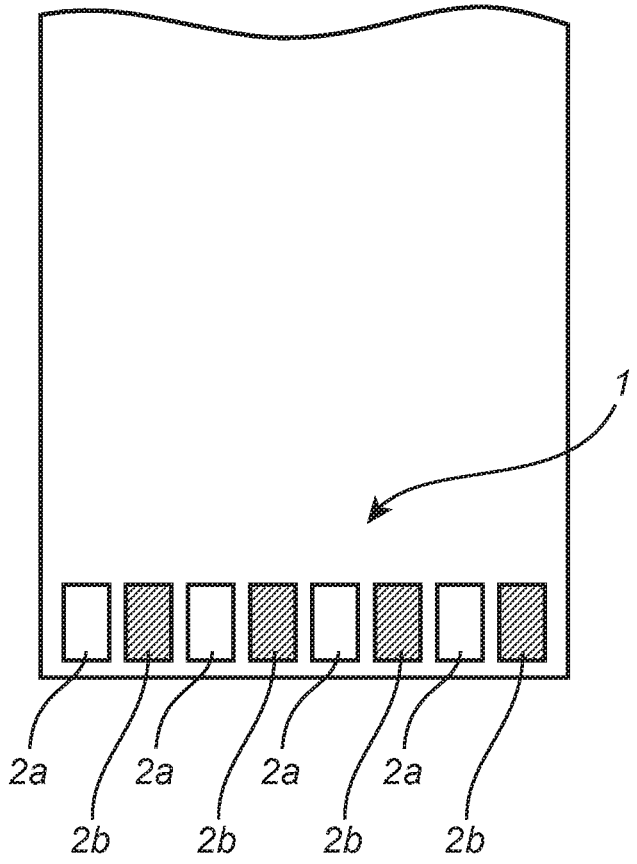
Fig. 1 (Prior art)
FIG. 1 illustrate a prior art antenna array with alternating antennas configured to emit vertically polarized electromagnetic radiation and horizontally polarized electromagnetic radiation, respectively.
Figure 3:
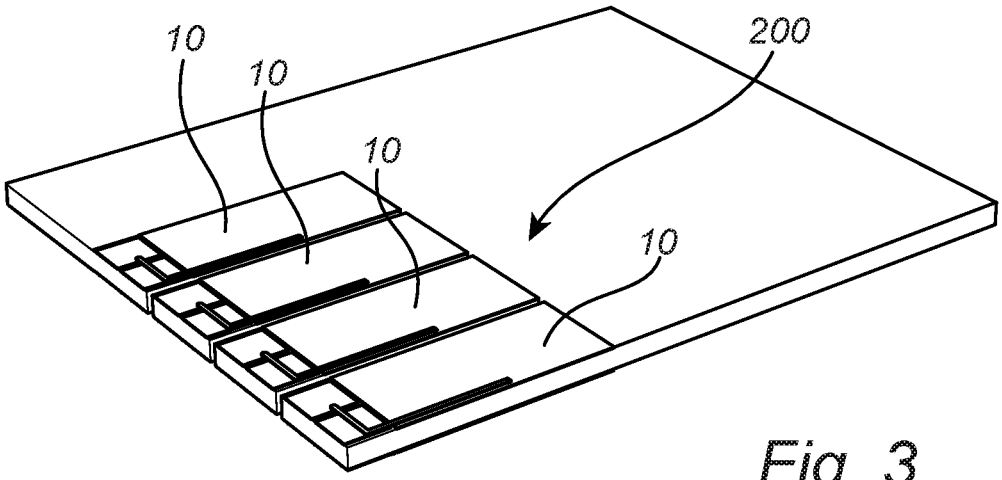
FIG. 3 illustrate an antenna array comprising a plurality of substrate integrated waveguide antennas.

In FIG. 3 an array antenna 200 comprising a plurality of SIW-antennas 10 as discussed above is illustrated. The plurality of SIW-antennas 10 may be configured to be individually feed. This will allow for flexible operation regarding beam forming and spatial multiplexing. However, separately feeing the plurality of SIW-antennas 10 may be complicated to implement. Alternatively, the plurality of SIW-antennas 10 may be collectively feed. This is easier to implement than individually feed SIW-antennas 10. Yet alternatively, the plurality of SIW-antennas 10 may be grouped into sub-groups, wherein each sub-group comprises one or more SIW-antennas 10. This may be a good tradeoff between the individually feed implementation and the collectively feed implementation. Further, the array antenna 200 according to this design may be made having a smaller footprint than e.g. the array antenna 1 of the prior art as illustrated in FIG. 1. This since every SIW-antenna 10 according to this design of the array antenna 200 may be configured to emit both horizontally and vertically polarized electromagnetic waves. In the prior art array antenna 1 of FIG. 1 the antennas 2*a* of the first sub-group of antennas is configured to emit vertically polarized electromagnetic waves and the antennas 2*b* of the first sub-group of antennas is configured to emit horizontally polarized electromagnetic waves. Hence, more antenna elements are needed in the prior art array antenna 1 than in the present array antenna 200.

Figure 4:
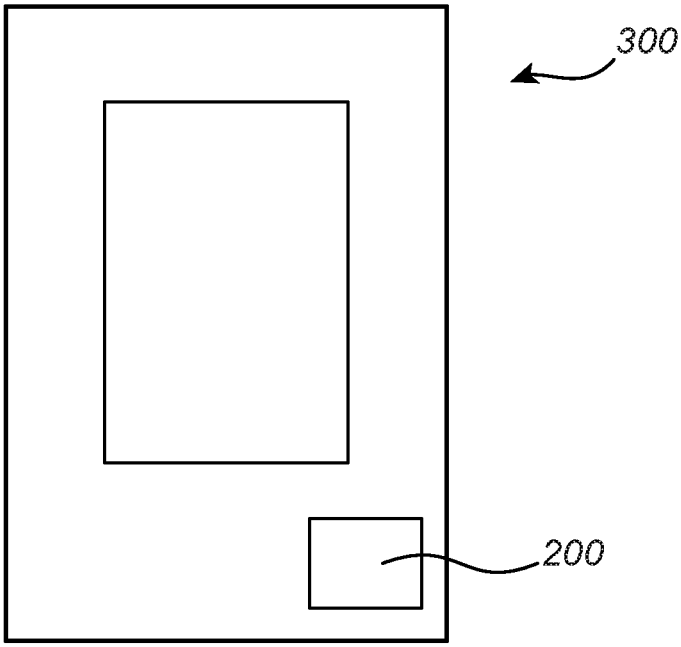
FIG. 4 illustrate an electronic device comprising an antenna array as illustrated in FIG. 3.

In FIG. 4 electronic device 300 configured to communicate within a millimeter wave communication system is illustrated. The electronic device 300 comprises an antenna array 200 according to the above.

The person skilled in the art realizes that the present invention by no means is limited to the preferred embodiments described above. On the contrary, many modifications and variations are possible within the scope of the appended claims.

For example, the two via fences 26*a*, 26*b* may, just as illustrated in FIG. 2, be arranged in parallel. However, other geometries may as well be used. The two via fences 26*a*, 26*b* may for example form a horn structure wherein the distance between the two via fences 26*a*, 26*b* are smaller at the first feed 26 than at the radiation aperture 27.

Further, the first feed 26 and the second feed 36 may be separate from each other. By this individually controllable antenna structures are formed Hence, the amount of vertically polarized electromagnetic radiation and the amount of horizontally polarized electromagnetic radiation may be individually controlled.

Additionally, variations to the disclosed embodiments can be understood and effected by the skilled person in practicing the claimed invention, from a study of the drawings, the disclosure, and the appended claims.

The invention claimed is:

1. A Substrate Integrated Waveguide antenna, comprising:

a SIW-structure extending along a horizontal plane for guiding electromagnetic waves along a longitudinal direction from a first feed to a radiation aperture, the SIW-structure comprising a rectangular upper layer extending in a first plane parallel with the horizontal plane, a rectangular lower layer extending in a second plane parallel with the horizontal plane, and first and second via fences extending in respective vertical planes at lateral edges of the rectangular upper and lower layers; and a parallel plate resonator arranged at the radiation aperture, the parallel plate resonator comprising a first flat portion extending in the first plane parallel with the horizontal plane and a second flat portion extending in the second plane parallel with the horizontal plane, wherein the first and second planes are separate from each other;

wherein the first flat portion comprises an additional antenna structure being connected to a second feed, and wherein the second flat portion comprises a plurality of flat tabs extending in the longitudinal direction, wherein the SIW-structure is configured to radiate electromagnetic waves polarized in a first direction and wherein the additional antenna structure is configured to radiate electromagnetic waves polarized in a second direction, wherein the second direction is orthogonal to the first direction.

2. The SIW antenna according to claim 1, wherein the first and second flat portions are asymmetric with respect to each other and are configured to reduce reflections at the radiation aperture.

3. The SIW antenna according to claim 1, wherein the first feed is separate from the second feed.

4. The SIW antenna according to claim 1, wherein the plurality of flat tabs are curved, triangle shaped, rectangular shaped, or frusto-triangular shaped.

5. The SIW antenna according to claim 1, wherein the plurality of flat tabs are electrically separated from each other.

6. The SIW antenna according to claim 1, wherein the plurality of flat tabs are electrically connected to each other.

7. The SIW antenna according to claim 1, wherein the SIW structure and the additional antenna structure are configured to radiate electromagnetic waves towards a common direction.

8. The SIW antenna according to claim 1, wherein the additional antenna structure comprises a flat patch for a flat monopole antenna.

9. The SIW antenna according to claim 1, wherein the additional antenna structure comprises at least two flat patches electrically insulated from each other.

10. The SIW antenna according to claim 9, wherein a first one of the at least two flat patches is connected to ground and wherein a second one of the at least two flat patches is connected to the second feed.

11. The SIW antenna according to claim 1, wherein the additional antenna structure is oriented transversely to the longitudinal direction of the SIW-structure.

12. The SIW antenna according to claim 1, wherein a distance between the upper and lower layers is in the range of 1.0-3.0 mm.

13. The SIW antenna according to claim 1, wherein the number of the plurality of flat tabs is in the range of 3-10.

14. An antenna array comprising a plurality of SIW antennas according to claim 1.

15. An electronic device configured to communicate within a millimeter wave communication system, the electronic device comprising:

an antenna array according to claim 14.

16. An electronic device configured to communicate within a millimeter wave communication system, the electronic device comprising:

a SIW antenna according to claim 1.

17. The SIW antenna according to claim 1, wherein the first rectangular layer and the second rectangular layer, and the first flat portion and the second flat portion, are respectively separated by a dielectric substrate in which the via fences are formed.

18. A Substrate Integrated Waveguide antenna, comprising:

a SIW-structure extending along a horizontal plane for guiding electromagnetic waves along a longitudinal direction from a first feed to a radiation aperture; and a parallel plate resonator arranged at the radiation aperture, the parallel plate resonator comprising a first flat portion extending in a first plane parallel with the horizontal plane and a second flat portion extending in a second plane parallel with the horizontal plane, wherein the first and second planes are separate from each other;

wherein the first flat portion comprises an additional antenna structure being connected to a second feed, and wherein the second flat portion comprises a plurality of flat tabs extending in the longitudinal direction, wherein the SIW-structure is configured to radiate electromagnetic waves polarized in a first direction and wherein the additional antenna structure is configured to radiate electromagnetic waves polarized in a second direction, wherein the second direction is orthogonal to the first direction; and wherein the additional antenna structure comprises at least two flat patches electrically insulated from each other.

19. The SIW antenna according to claim 18, wherein a first one of the at least two flat patches is connected to ground and wherein a second one of the at least two flat patches is connected to the second feed.

* * * * *